United States Patent [19]

Wahren

[11] 4,240,872

[45] Dec. 23, 1980

[54] SUSPENSION DEVICE FOR A HEADBOX FOR PAPER AND PULP MACHINES

[75] Inventor: Douglas Wahren, Karlstad, Sweden

[73] Assignee: AB Karlstads Mekaniska Werkstad, Karlstad, Sweden

[21] Appl. No.: 19,940

[22] Filed: Mar. 13, 1979

[30] Foreign Application Priority Data

Mar. 17, 1978 [SE] Sweden ..... 7803137

[51] Int. Cl.[3] ..... D21F 1/02

[52] U.S. Cl. ..... 162/344; 162/301; 162/336

[58] Field of Search ..... 162/347, 344, 336, 302, 162/301, 303

[56] References Cited

U.S. PATENT DOCUMENTS

| | | | |
|---|---|---|---|
| 3,341,400 | 9/1967 | Grater | 162/347 |
| 3,562,107 | 2/1971 | Schmaeng | 162/336 |
| 3,582,467 | 6/1971 | Gustafson | 162/303 |
| 3,876,498 | 4/1975 | Justus | 162/301 X |
| 3,944,465 | 3/1976 | Wolf | 162/336 |

*Primary Examiner*—Richard V. Fisher

*Attorney, Agent, or Firm*—Brumbaugh, Graves, Donohue & Raymond

[57] ABSTRACT

A headbox for paper and pulp machines is pivotally mounted at the ends of a plurality of control links secured to the machine frame and pointing from the machine frame towards a center of rotation in the vicinity of the headbox slice opening. The angular relation and the vertical position of the headbox with respect to a web forming zone are accurately set by controlling the rotation and translation of the respective control links and the headbox thereafter is maintained rigidly fixed in the set position.

11 Claims, 3 Drawing Figures

SUSPENSION DEVICE FOR A HEADBOX FOR PAPER AND PULP MACHINES

BACKGROUND OF THE INVENTION

The present invention relates to suspension means for a headbox for paper and pulp machines and, more particularly, to headbox suspension means that is selectively adjustable to bring the jet of stock discharged from the slot-shaped slice opening into proper alignment in relation to a forming zone.

For the formation of a good fibrous web, it is essential that the stock be discharged into the forming zone at the proper elevation and angular position for the particular furnish, stock velocity and jet thickness employed. An accurately adjustable suspension for the headbox is therefore important and it must be sufficiently rigid to hold its adjustment so as to prevent inadvertent alteration of the aligned jet geometry in relation to the forming geometry.

It has been propose, heretofore, to mount the headbox of a paper-making machine on a pair of swingably journalled supports having oppositely inclined lower surfaces resting on complementary-shaped wedges movable in the machine direction by means of a common threaded spindle, as shown in German Auslegeschrift No. 23 20 312 (equivalent to U.S. Pat. No. 3,944,465). By rotating the spindle, the wedges are caused to raise or lower the headbox and to rotate it about an axis which may be located either at the slice discharge opening or at the center of a supply pipe for the headbox.

SUMMARY OF THE INVENTION

It is an object of the invention to provide new and improved suspension means for a headbox that is capable of meeting the above requirements for adjustability and rigidity in a simple and reliable manner.

According to the invention, a headbox is suspended on upper and lower control links pivotally mounted at like ends on upper and lower spaced apart pivots, respectively, on at least one side of the headbox. The other end of one link is mounted on the machine frame with provision for rotating it about a fixed axis thereon, and the other end of the other link is mounted on the machine frame with provision for translating it in the direction of its length.

Preferably, the control links converge to a center of rotation in the vicinity of the slice opening, e.g. the line of impingement of the stock jet in the forming zone, and the length of each link preferably approximates the distance from the center of rotation to the point where the link is pivotally mounted on the headbox. Also, the headbox pivot which supports most of the weight of the headbox is desirably located near a vertical line through the headbox center of gravity but slightly displaced therefrom towards the tip of the headbox.

Rotation of the one control link causes a substantially pure rotary motion of the headbox within relatively wide limits about a center of rotation in the vicinity of the slice opening. Translation of the other link adjusts the slice opening vertically in relation to the forming zone. By controlling the rotation and translation of the respective links, both the angular relation and the vertical position of the headbox with respect to the forming zone can be accurately set and the headbox maintained rigidly fixed in the correctly set position thereafter.

DESCRIPTION OF PREFERRED EMBODIMENTS

The invention may be better understood from the following detailed description, taken in conjunction with the accompanying drawings in which.

Figure 1:
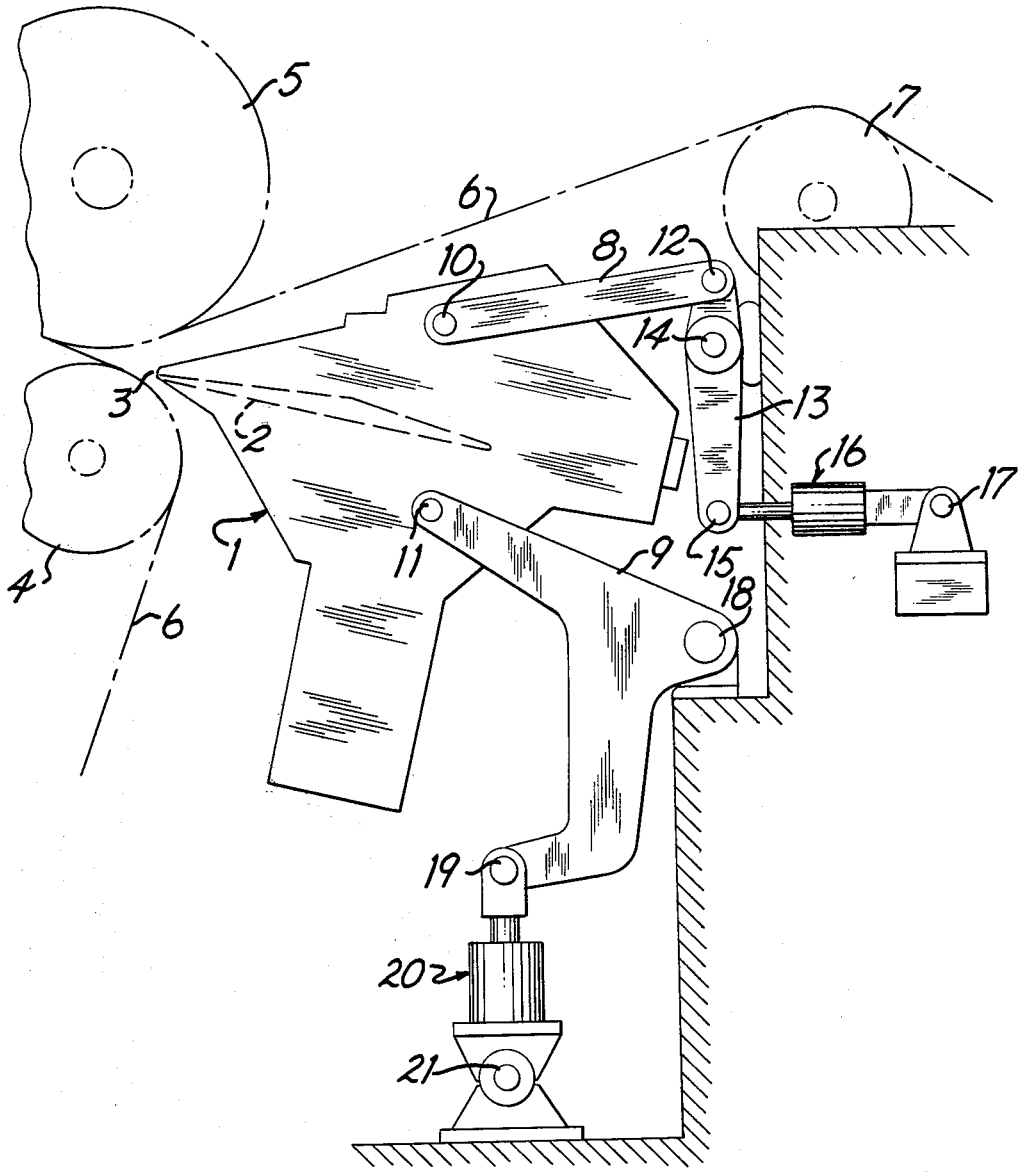
FIG. 1 is a schematic side view of apparatus constructed according to the invention for the suspension and adjustment of a headbox.

In FIG. 1 is shown a conventional headbox 1 having a slice chamber 2 for discharging stock through a slice opening 3 into a forming zone between a pair of running wires 6. The inner wire 6 is adapted to run over a guide roll 7 and around a forming roll 5, while the outer wire 6 is adapted to run around a breast roll 4 and the forming roll 5, as shown.

According to the invention, the headbox 1 is suspended by a linkage comprising a top control link 8 and a bottom control link 9 which are pivotally connected at one end to the headbox 1 at 10 and 11. The other end of the top control link is pivotally connected at 12 to one arm of a lever 13 which is pivotally mounted intermediate its ends to the machine frame at 14. The other end of the lever 13 is pivotally connected at 15 to the actuator rod of a conventional jack 16 which, in turn, is pivotally mounted on the machine frame at 17. The bottom control link 9 constitutes one arm of a kind of bell crank which is pivotally mounted to the machine frame at 18 and has an actuator arm pivotally connected at 19 to the actuator rod of a conventional jack 20 pivotally mounted at 21 on the machine frame.

As shown in FIG. 1, the control links 8 and 9 should point substantially at a center of rotation in the vicinity of the slice opening, e.g. the line of impingement of the stock jet in the forming zone. Also, the pivot points 10 and 11, respectively, should be located approximately half the distance between the pivot points 14 and 18 and the slice opening 3, which distance should also be made as large as practicable.

In other words, the lengths of the control links 8 and 9 should be substantially equal to the distances between the slice opening 3 and the pivot points 10 and 11, respectively.

In order to insure that restoring forces and gravity act in the same direction at each set position and thus avoid play at the pivot points, the pivot point 11 supporting most of the weight of the headbox 1 should be located near but not actually on a vertical line through the headbox center of gravity. Preferably, it should be displaced a small amount (a few centimeters) towards the headbox slice opening.

Preferably, linkages and jacks as described above and illustrated in FIG. 1 are provided on both sides of the headbox 1. So mounted, the headbox 1 is rigidly suspended, yet is easily adjustable relative to the forming zone between the breast roll 4 and the forming roll 5 so as to enable the stock jet to be correctly positioned in elevation and inclination for optimum web formation with the furnish, stock jet thickness and stock velocity used. Thus, by actuation of the jack 20 alone, the headbox can be given a substantially pure rotary motion within relatively wide limits about an imaginary pivot axis located on the chosen center of rotation in the vicinity of the slice opening. The position of the slice opening 3 in the headbox 1 can also be finely adjusted vertically in relation to the forming zone by activating the jack 16 alone to change the position of the pivot 10 in relation to the pivot 14 mounted on the frame as the headbox rotates about the pivot 11 at the end of the control link 9. For the small movements involved here, the position of the slice opening 3 in a horizontal direction will remain very nearly constant.

By operation of the jacks 16 and 20 in the manner described, the headbox can easily be adjusted to bring the stock jet to the correct position in elevation and inclination required for proper web formation. In addition, the headbox rotary motion and the vertical travel of the slice opening are non-interactive to such an extent that limit switches can be mounted directly on the jacks instead of between the headbox, rolls, etc., which is considerably more difficult to do.

Figure 2:
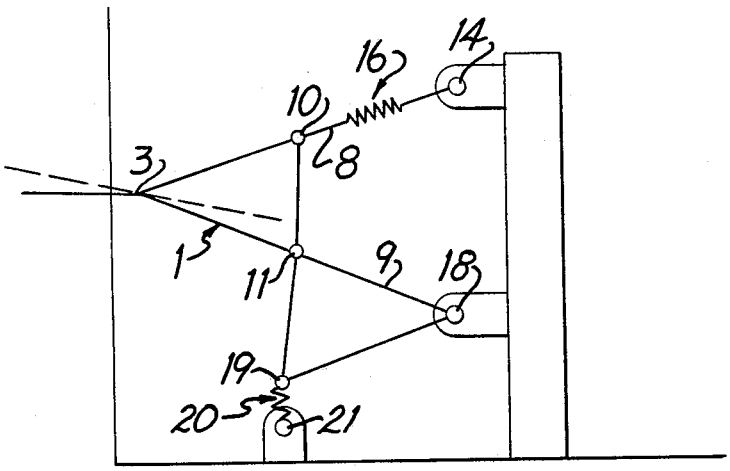
FIG. 2 illustrates schematically a modification of FIG. 1 in which the upper link is adapted to be translated by a jack interposed between it and the machine frame.

In the modification shown in FIG. 2, the lever arm 13 is dispensed with and the jack 16 is pivotally mounted to the frame at 14 and has its actuator directly connected to the upper link 8 so as to alter the length of the latter as it is actuated. By activating the jack 20 which is connected to the control link 9 supporting most of the weight of the headbox 1, an almost pure rotation of the latter about the selected center of rotation (the slice opening or line of impingement of the jet in the forming zone) is obtained. Also, by activating the jack 16 while the jack 20 is at rest, the length of the control link arm 8 can be changed to provide an almost pure vertical travel of the slice opening 3.

Figure 3:
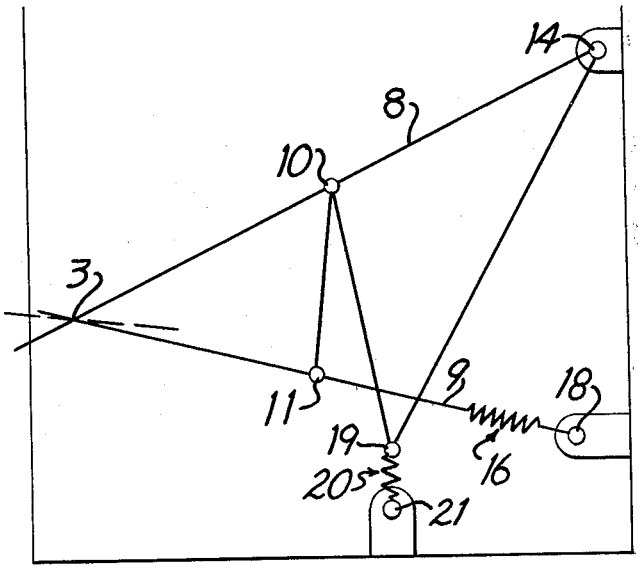
FIG. 3 is a schematic diagram of a further modification of the invention.

The embodiment shown in FIG. 3 differs from FIG. 2 only in that the positions of the jacks 16 and 20 are reversed, the jack 16 being connected to adjust the length of the control link 9, and the jack 20 being connected to rotate the control link 8 about its pivot 14. However, the bottom jack 20 still supports a major part of the headbox load and rotates the headbox 1 while the jack 16 raises and lowers the slice opening 3.

Although not shown, e.g. pivot points 11 and 18 in FIG. 2 and the pivot 14 in FIG. 3 can be made adjustable in a direction not at right angles to the length of the control links 9 and 8 in order to enable the headbox to be correctly adjusted at erection or during major changes in production conditions.

Although two jacks are shown in FIGS. 2 and 3 for imparting rotation and translation, respectively, to the two links (actually two pairs of jacks, one on each side, one pair of which carries a substantial part of the headbox load and, when activated, pivots the headbox at constant link arm length about a selected center of rotation in or close to the slice opening, and the other pair of which changes the length of one of the control links in order to raise or lower the headbox slice opening), the jacks could be connected to impart rotation and translation to the same control link, although the resulting structure might not be quite as rigid. Also, by locating the pivot point 11 in FIG. 2 and the pivot point 10 in FIG. 3 sufficiently close to a vertical line through the center of gravity of the headbox 1, it is possible, in view of the great torsional rigidity of the headbox, to reduce the forces on the jack 16 to such an extent that it alone suffices, and to link the arms 8 and 9 with fulcrums 10 and 11, respectively, at one side of the headbox.

The several embodiments described above are intended to be merely illustrative and modifications in form and detail are possible within the skill of the art. Thus, the bottom jack 20 can be attached to the same frame wall as that on which the pivot points 14 and 18 are supported. Moreover, other power elements than jacks can be used. The invention is intended to encompass all such modifications as fall within the scope of the following claims.

I claim:

1. Apparatus for suspending a headbox for paper and pulp machines adjustably to bring the headbox slice opening in predetermined relation to a web forming zone comprising a first link extending generally in the direction of the slice opening and having one end near the slice opening pivotally mounted on the headbox and another end away from the slice opening movably supported on a frame, a second link extending generally in the direction of the slice opening in spaced relation to said first link and having one end near the slice opening pivotally mounted on the headbox and another end away from the slice opening pivotally supported on said frame, said first and second links converging in the direction of the slice opening, and means for translating one of said links in the direction of its length to move the headbox so as to adjust the position of the slice opening in relation to the web forming zone.

2. Apparatus as defined in claim 1 in which means is provided for rotating one of said links about its frame pivot to impart rotary motion to the headbox about an axis in the vicinity of the slice opening.

3. Apparatus as defined in claim 2 in which the length of the first link is substantially equal to the distance between the headbox slice opening and the location where said first link one end is pivotally mounted on the headbox, the length of the second link is substantially equal to the distance between the headbox slice opening and the location where said second link one end is pivotally mounted on the headbox, the rotating means is adapted to rotate the second link about its pivot and the translating means is adapted to translate the first link in the direction of its length.

4. Apparatus as defined in claim 3 in which said second link one end is located near a vertical line through the headbox center of gravity.

5. Apparatus as defined in claim 4 in which the location of said second link one end is slightly displaced in the direction of the headbox slice opening from said vertical line.

6. Apparatus as defined in claim 5 in which said second link constitutes one arm of a bell crank pivotally mounted on the frame and having an actuator arm connected to power means for applying force thereto to rotate said second link about said frame pivot.

7. Apparatus as defined in claim 6 in which said first link another end is pivotally mounted at one end of a lever arm which is pivotally mounted to the machine frame at a location intermediate its ends, and power means is connected to the other end of said lever arm for applying force thereto to translate said first link in the direction of its length.

8. Apparatus as defined in claim 6 in which the means for translating said first link in the direction of its length comprises a jack interposed between said first link another end and the machine frame.

9. Apparatus as defined in claim 5 in which said first link constitutes one arm of a bell crank pivotally mounted on the frame and having an actuator arm connected to power means for applying force thereto to rotate said first link about said frame pivot and in which means is provided for translating said second link in the direction of its length, said translating means comprising a jack interposed between said second link another end and the machine frame.

10. Apparatus for suspending a headbox for paper and pulp machines adjustably to bring the headbox slice opening in predetermined relation to a web forming zone comprising a first link extending generally in the direction of the slice opening and having one end near the slice opening pivotally mounted on the headbox and another end away from the slice opening movably supported on a frame, a second link extending generally in the direction of the slice opening in spaced relation to said first link and having one end near the slice opening pivotally mounted on the headbox and another end away from the slice opening pivotally supported on said frame, said first and second links converging in the direction of the slice opening, and means for rotating one of said links about its frame pivot to impart a rotary motion to the headbox about an axis in the vicinity of the slice opening.

11. Apparatus for suspending a headbox for paper and pulp machines adjustably to bring the headbox slice opening in predetermined relation to a web forming zone comprising a first link extending generally in the direction of the slice opening and having one end near the slice opening pivotally mounted on the headbox and another end away from the slice opening movably supported on a frame, a second link extending generally in the direction of the slice opening in spaced relation to said first link and having one end near the slice opening pivotally mounted on the headbox and another end away from the slice opening pivotally supported on said frame, means for translating one of said links in the direction of its length, and means for rotating the other of said links about its frame pivot, said translating and rotating means being operable to adjust the position of the slice opening in relation to the web forming zone and to impart rotary motion to the headbox about an axis in the vicinity of the slice opening.

* * * * *